US006509697B2

(12) United States Patent
Ervin et al.

(10) Patent No.: US 6,509,697 B2
(45) Date of Patent: Jan. 21, 2003

(54) COMPACT MICROWAVE-POWERED LAMP, INKJET PRINTER USING THIS LAMP, AND ULTRAVIOLET LIGHT CURING USING THIS LAMP

(75) Inventors: Robert Ervin, Gaithersburg, MD (US); Gregory Walter, Frederick, MD (US); David Snyder, Frederick, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 09/771,671

(22) Filed: Jan. 30, 2001

(65) Prior Publication Data

US 2002/0101491 A1 Aug. 1, 2002

(51) Int. Cl.[7] ..... H05B 41/24

(52) U.S. Cl. ..... 315/248; 315/39.51; 315/112; 315/344; 347/100; 313/35

(58) Field of Search ..... 315/248, 112, 315/39, 39.51, 267, 344, 117, 118; 347/102, 100, 118; 313/35, 44, 148, 149

(56) References Cited

U.S. PATENT DOCUMENTS 4,359,668 A * 11/1982 Ury ..... 250/372
5,021,704 A * 6/1991 Walker et al. ..... 313/35
5,039,918 A * 8/1991 Ohtake et al. ..... 315/248
5,467,119 A * 11/1995 Richtsmeier et al. ..... 347/102
5,471,109 A * 11/1995 Gore et al. ..... 313/22
5,682,080 A * 10/1997 Dolan et al. ..... 313/234
5,847,517 A * 12/1998 Ury et al. ..... 313/231.61
5,866,990 A * 2/1999 Ury et al. ..... 315/112
5,998,934 A * 12/1999 Mimasu et al. ..... 313/35
6,102,536 A * 8/2000 Jennel ..... 347/100
6,145,979 A * 11/2000 Caiger et al. ..... 347/102

* cited by examiner

*Primary Examiner*—Haissa Philogene
(74) *Attorney, Agent, or Firm*—Antonelli, Terry, Stout & Kraus, LLP

(57) ABSTRACT

A compact, electrodeless, microwave-powered lamp (e.g., ultraviolet light emitting lamp) is provided, as well as methods of using this lamp. The lamp includes a microwave generator, waveguide and RF cavity. The RF slot between the waveguide and RF cavity, for introducing microwaves from the waveguide into the RF cavity, extends through an end member forming the RF cavity rather than through the elliptical-shaped reflector; and the RF slot is aligned with the bulb. Cooling air for cooling the bulb passes through the RF slot, and preferably this cooling air passes by both the bulb and microwave generator for cooling both. The bulb is rotated during use. The compact size of the lamp facilitates its use in small devices, such as inkjet printers for office use to cure ultraviolet light curable inkjet inks, among other uses.

79 Claims, 5 Drawing Sheets

COMPACT MICROWAVE-POWERED LAMP, INKJET PRINTER USING THIS LAMP, AND ULTRAVIOLET LIGHT CURING USING THIS LAMP

BACKGROUND

The present invention is directed to a compact microwave-powered lamp, which is small and lightweight, and can provide focused light at a small distance from the lamp. The present invention is especially directed to an electrodeless compact microwave-powered lamp, for emitting ultraviolet light. Such a lamp can be used in small devices such as office products (e.g., inkjet printers for the office), and for larger devices, and not only for producing ultraviolet light for industrial applications.

The present invention is also directed to techniques using ultraviolet light or other type of light (e.g., visible light) for curing purposes (for example, for curing ultraviolet light curable inks, or coating materials, or various plastics). This aspect of the present invention is particularly directed to techniques for curing inkjet inks deposited, for example, by an inkjet printer, having utility in many applications including inkjet printers for the office.

Use of microwave-powered lamps for producing ultraviolet light for curing processes is known. It is known to use, e.g., electrodeless, microwave-powered lamps, to produce the ultraviolet light for such curing. However, existing electrodeless, microwave-powered lamps are too large, too heavy and use too much air for cooling, to be considered for some ultraviolet light curing processes. In addition, existing high-powered electrodeless lamps for ultraviolet light curing require an auxiliary ignitor bulb to start the main bulb emitting ultraviolet light, and it is desired to provide an electrodeless lamp that does not require such auxiliary ignitor bulb.

Moreover, existing arc lamps have a short lamp life, and the spectral output changes with use; this is especially true with iron additive lamps. In addition, peak energy focused by the arc lamp is inferior, because the bulb diameter is relatively large for a given power density, and the position of the arc is imprecisely located within the ellipse.

In both arc lamps and existing electrodeless lamps, portions of the elliptical reflector are removed, for air flow purposes, and this reduces the energy being focused by the reflector.

U.S. Pat. No. 5,998,934 to Mimasu et al. discloses a microwave-excited discharge lamp apparatus which emits light by discharge under a microwave electromagnetic field. The structure of this device includes a microwave generator for generating a microwave, a waveguide for propagating the microwave to a cavity resonator unit, and a microwave discharge lamp arranged in the cavity resonator unit, the microwave-excited discharge lamp apparatus including a rotary supporter for supporting the lamp rotatably, and a blow guide arranged around the lamp in the cavity resonator unit for conducting a cooling air to the lamp for cooling the lamp. According to U.S. Pat. No. 5,998,934, the microwave generator and the cavity are provided at opposite sides of the waveguide and at opposite ends thereof, and microwaves from the waveguide are introduced into the cavity through a curved reflector of the cavity-forming member.

In the structure of Mimasu et al., by having the microwave-introducing window (and structure for rotating the bulb) extending through the curved reflector forming the cavity in which the bulb is positioned, a substantial portion of the reflector is removed, whereby the curved portion of the reflector inefficiently reflects the light emitted from the bulb. Moreover, this structure of Mimasu et al., having the bulb rotator, microwave generator and RF cavity positioned so as to include structure on opposite sides of the waveguide structure, takes up a lot of room.

U.S. Pat. No. 5,866,990 to Ury et al. discloses a microwave-powered, electrodeless lamp, utilizing a single rotary motor to rotate the bulb and provide rotary motion to a blower or pump means for providing cooling fluid to the magnetron and/or to a forced gas cooling for providing cooler gas to the bulb. This patent discloses structure wherein the bulb is rotated to provide various advantages including temperature equalization around the bulb surface, improved spatial emission properties, discharge stabilization, elimination of visual "wobble", increased efficiency and better cooling, and provides, for example, cooling of the magnetron used to provide the microwaves. The contents of U.S. Pat. No. 5,866,990 are incorporated herein by reference in their entirety.

U.S. Pat. No. 6,102,536 to Jennel discloses apparatus and a method for printing images on packaging material, including jetting ink through an inkjet print head onto a surface of a web. The printing site includes, inter alia, a printer and a curing device, the printer having at least one print head, for example, an inkjet print head. The curing device, where the inks are ultraviolet light-reactive inks, can, for example, be an ultraviolet light source. This is a typical illustrative example (and not to be limiting) of an environment for use of lamps (e.g., microwave-powered lamps) as in the present invention.

As can be seen from the foregoing, while various microwave-powered, e.g., electrodeless lamps, and also arc lamps, are known, it is still desired to provide microwave-powered lamps having a compact size, which are lightweight, and have stable light (e.g., stable ultraviolet light) spectral output. It is also desired to provide such a lamp which can operate on 120 or 230 volt power (residential or office power, rather than industrial levels), and has low air-cooling requirements. It is desired to provide such compact lamp, which has applicability to smaller devices such as office products. (e.g., inkjet printers). It is also desired to provide a lamp having a compact size and is lightweight, and yet wherein a tubular or cylindrical bulb of the lamp can be rotated.

It is also desired to provide techniques for printing, coating, marking or imaging including curing or drying the printed, coated, marked or imaged structure, using such lamp.

SUMMARY

The foregoing objectives are achieved by the lamp structure and method of using such structure, according to the present invention, discussed in the following. Generally, the structure of the present invention includes a microwave generator, a waveguide, and an RF cavity. The RF cavity has positioned therein a bulb, of the microwave-powered lamp. The waveguide is provided for directing microwaves generated in the microwave generator to the cavity (which, as known in the art, is a cavity resonator, for accumulating microwave energy). The cavity is defined by end members and a member extending therebetween (this member extending therebetween being, e.g., curved, and having, for example, a cross-sectional shape of a partial ellipse with an opening at one end). This member extending between the two end members is, desirably, a primary reflecting member forming the boundary of the cavity. The cavity is positioned adjacent to the waveguide such that one of the end members is positioned so as to overlap a side of the waveguide. An RF slot extends from the waveguide through the side of the waveguide, and through this one of the end members positioned so as to overlap a side of the waveguide, into the RF cavity, for introduction of the microwaves from the waveguide into the RF cavity.

By providing the RF slot through the end member (e.g., end reflector) instead of, e.g., the reflecting structure between the end members (e.g., the member having the partial elliptical shape in cross-section), energy focus is improved. In addition, the compact nature of the structure can also be improved.

The cavity is positioned to overlap the side of the waveguide so that the RF slot can extend into the cavity. As can be appreciated, the cavity, extending along the side of the waveguide, can extend beyond the end of the waveguide.

Desirably, another end member defining the RF cavity, opposite the end member having the RF slot therethrough, has an opening therethrough for inserting the bulb into the RF cavity. Here also, by providing the bulb through this other end member, a break in the reflector surface between the end members (that is, the member extending between the end members) is avoided, improving effectiveness of emission of radiation (for example, ultraviolet light) from the lamp.

The structure according to the present invention can also include structure to rotate the bulb in the cavity, providing advantages of such rotation, as discussed previously, in a relatively compact structure.

In addition, the structure according to the present invention can also include structure (for example, but not to be limiting, a fan or blower, or a source of compressed cooling fluid (such as compressed air)) to pass cooling fluid (such as air) by the bulb for forced cooling of the bulb. This cooling fluid passing by the bulb passes through the RF slot in passing into the cavity or passing out of the cavity, providing a compact path for passing of the cooling fluid. Desirably, the, e.g., fan or blower is provided such that the cooling fluid passing by the bulb and through the RF slot also is forced to flow past the microwave generator (for example, magnetron), for also cooling the microwave generator.

Under some circumstances, rotation of the bulb, using the structure to rotate, provides sufficient bulb cooling without the need for additional cooling structure.

According to another aspect of the present invention, the RF slot between the waveguide and cavity is in one end member of the RF cavity, and the bulb of the microwave-powered lamp extends from an opposite end member of the cavity. The bulb is aligned with the RF slot when positioned in the RF cavity, so as to achieve most effective use of the microwave energy for emission of light (e.g., ultraviolet light) from the bulb. For example, this alignment is achieved by a central axis of the bulb (e.g., a cental axis of a tubular bulb), when extended beyond the bulb, intersecting the RF slot (desirably, a center line of the RF slot).

According to other aspects of the present invention, the microwave-powered lamp has a bulb which emits ultraviolet light and/or visible light, of relatively high intensity, and is used for ultraviolet or visible light curing of various materials, such as, but not limited to, paper, plastics, textiles and foils, and curing of inks and coatings of various materials, including inks and various plastics. In one embodiment of use of this compact microwave-powered lamp, the lamp is used as a curing device used in conjunction with a print head of an inkjet printer, for curing ultraviolet light-cured inks deposited by an inkjet printing head. The compact microwave-powered lamp according to the present invention can, for example, be used as a substitute for the described curing device in U.S. Pat. No. 6,102,536. Of course, the lamp according to the present invention is not limited to use in an inkjet printer, but rather has many various uses, including (but not limited to) any printing, marking, bonding or imaging process such as in medical uses, small-part curing and wire marking, packaging, and curing of component electronic structures.

The microwave generator utilized according to the present invention can be a conventional magnetron; for example, the microwave energy can be produced using a 1000 watt consumer oven magnetron. Various relatively small components can be used; for example, the bulb used can be a tubular bulb approximately 50 mm long, the outside diameter thereof chosen varying from 7 mm to 18 mm depending on the power level desired and the cooling scheme used. The waveguide can be small, e.g., very short (e.g., about 4.7 inches long by 2.8 inches wide by 1.7 inches high); and the height of the cavity, and minor and major diameters thereof, and the short waveguide, create compactness of the lamp.

Illustratively, the RF cavity can have a partial elliptical surface between the two end members, with the two end members being spaced 3.0 inches. The elliptical shape of the partial elliptical reflector can have a major diameter of 4.31 inches and a minor diameter of 3.54 inches. These dimensions are examples and are not to be limiting of the present invention.

In addition, according to the present invention, having cooling air at least for the bulb, and preferably for both the magnetron and bulb, passing through the RF slot, a further compact structure is provided, which is relatively quiet, especially for use in an office product (inkjet printer).

As compared to arc lamp alternatives, the microwave-powered lamp according to the present invention provides a stable ultraviolet light output during operation, a longer lamp life and higher peak energy at focus.

Moreover, as compared to alternative electrodeless lamp devices, the present invention provides a lamp of compact size, less weight and low air cooling requirements. Furthermore, the rotating tubular lamp provides for uniform stress along the bulb wall, with respect to both thermal and electric field stresses, as well as other benefits.

In addition, the microwave-powered lamp according to the present invention starts without an ignitor bulb. That is, with structure according to the present invention, sufficient microwave energy can be provided to the RF cavity to create an electric field in the RF cavity which ignites the lamp bulb without the need for an ignitor bulb.

Furthermore, by providing the RF slot on the end member, instead of through the, e.g., elliptical-shaped reflector, energy focus is improved and compactness is also improved. In addition, this structure permits the product focus to be closer to the lamp, for example, 0.38 inches versus 2.1 inches. By providing positioning of the slot relative to the bulb as in aspects of the present invention, effectiveness of use of the microwave energy is improved.

In addition, through use of cooling air flow through the RF slot, according to various aspects of the present invention, the same lamp configuration can be cooled with positive or negative pressure.

DETAILED DESCRIPTION

Figure 1A:
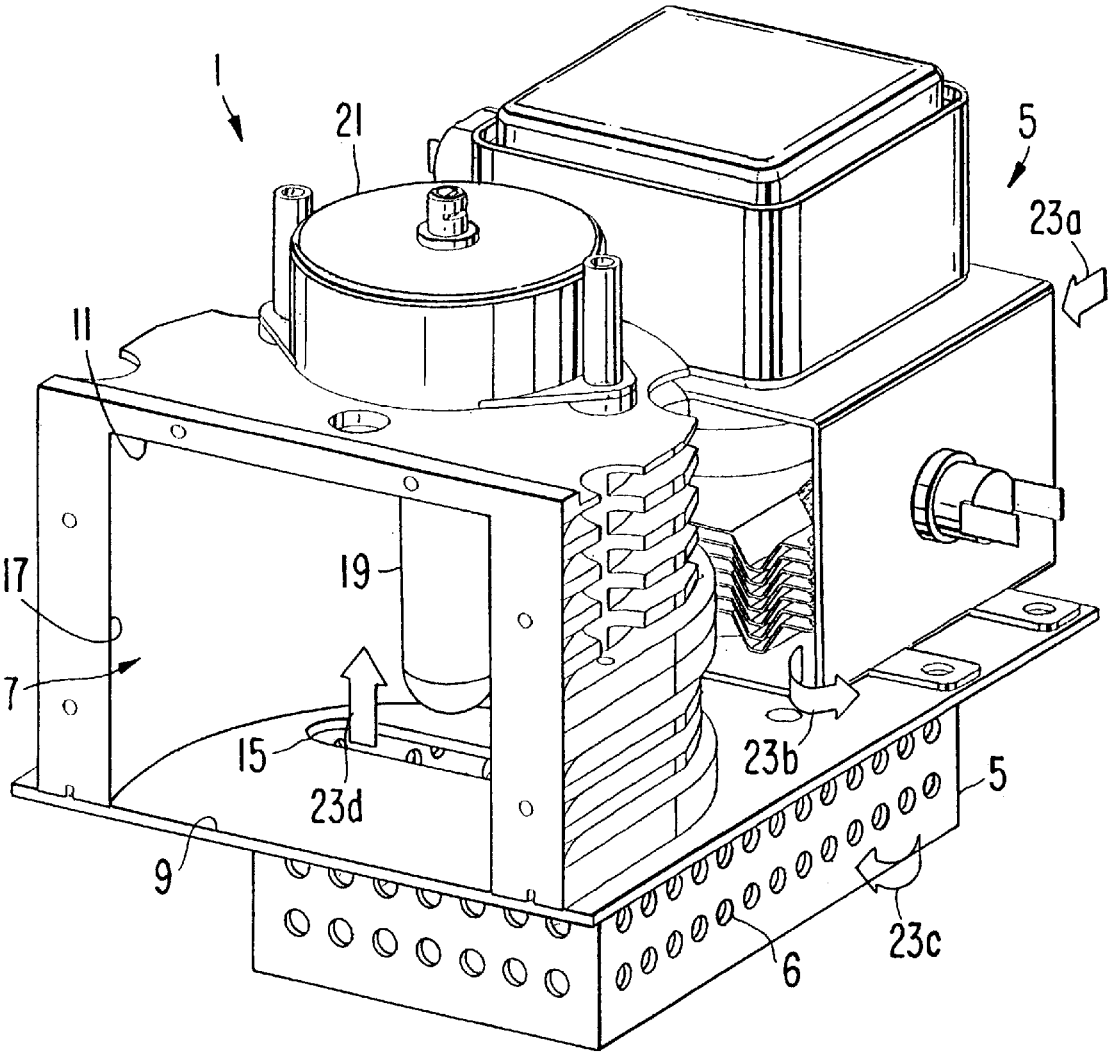
FIG. 1*a* is a perspective view of a first embodiment of the present invention.

While the present invention will be described in connection with specific and preferred embodiments, it will be understood that it is not intended to limit the invention to those embodiments. To the contrary, it is intended to cover all alterations, modifications and equivalents as may be included within the spirit and scope of the invention as defined by the appended claims.

Throughout the present specification, where apparatus and methods are described as including or comprising specific components or structure, or specific processing steps, it is contemplated by the inventors that apparatus and methods of the present invention also consist essentially of, or consist of, the recited components or structure, or recited processing steps.

In the following descriptions of the drawing figures, like components in the different drawing figures are represented by the same reference characters.

The present invention contemplates, as one aspect thereof, structure of a microwave-powered lamp. The structure includes a microwave generator (for example, a magnetron, which can be a 1000 watt consumer oven magnetron) and an RF cavity, adapted to have positioned therein a bulb of the microwave-powered lamp. The bulb can be, for example, a bulb which includes a fill material such that, when the bulb is excited by microwaves, emits, for example, ultraviolet light or visible light. A waveguide for directing microwaves generated by the microwave generator to the RF cavity is connected between the microwave generator and the RF cavity. A slot is provided between an end member of the RF cavity and a side of the waveguide, for introduction of the microwaves from the waveguide into the RF cavity. Desirably, this slot is aligned with the bulb provided in the cavity. For example, a central line of the slot can intersect an extension of an axis of a tubular or cylindrical bulb in the RF cavity.

The present invention also contemplates that the bulb (e.g., a tubular bulb) is inserted into the RF cavity from an end member forming the cavity, which is opposite the end member (forming the cavity) that has the slot therein. Thus, according to an aspect of the present invention, the tubular bulb extends substantially perpendicular to the end member, forming the cavity, that has the slot therein for introduction of microwaves.

According to further aspects of the present invention, both the magnetron and the RF cavity are on the same side of the waveguide. Moreover, according to still further aspects of the present invention, the bulb can be rotated while emitting light, and cooling fluid, such as cooling air, can be caused to flow by the bulb, through the RF slot, for cooling the bulb. Desirably, such fluid flow also passes by the microwave generator (magnetron), to cool the microwave generator.

According to additional aspects of the present invention, the microwave-powered lamp, emitting ultraviolet light and/or visible light, can be utilized for ultraviolet light or visible light curing of various materials, such as, but not limited to, paper, plastics, textiles and foils, and also curing of, e.g., inks and coatings of various materials; and also can form part of an inkjet printing system for curing ultraviolet light curable inkjet printing ink.

FIG. 1*a* shows a microwave-powered lamp 1 according to the present invention. Shown is lamp 1, having magnetron 3 and RF cavity 7 on a same side of waveguide 5. The cavity 7 is defined by respective end members 9 and 11, and by member 17, which extends between end members 9 and 11 and provides a curved surface, which is preferably a reflecting surface. Desirably, member 17 has a shape of a partial ellipse, cut off to form the opening of cavity 7 which emits light. In the embodiment shown in FIG. 1*a*, the member 17 is made as a single member forming the cavity 7, but can be made of a plurality of parts connected together to form cavity 7.

Also shown in FIG. 1*a* is RF slot 15, for introducing microwaves from waveguide 5 into cavity 7. As can be appreciated from FIG. 1*a*, also shown is bulb 19, which is aligned with slot 15. For example, an extension of a central axis of bulb 19, which is tubular, intersects a central line extending in the lengthwise direction of slot 15.

FIG. 1*a* also shows bulb rotation motor 21. This bulb rotation motor causes rotation of bulb 19 during operation of the lamp, providing advantages as discussed previously.

Also shown schematically in FIG. 1*a* is the air flow pattern through lamp 1. This represents flow of air past the bulb, for purposes of cooling the bulb. Although not shown in FIG. 1*a*, lamp 1 would, illustratively, be within a housing. Air flow 23*a* would pass by magnetron 3, to cool the magnetron, and then pass out of magnetron 3 as represented by arrow 23*b*. Air could then pass into waveguide 5 through holes 6 therein, as represented by arrow 23*c*. Air would then flow through RF slot 15, as represented by arrow 23*d*, to cool bulb 19 in cavity 7. Thus, the air flow could be used to cool both the bulb and magnetron.

While described as an air flow, as can be appreciated by one of ordinary skill in the art any cooling fluid can be utilized. Moreover, while air flow is shown in a direction from magnetron 3 to bulb 19, the air flow can be in the reverse direction.

Figure 1B:
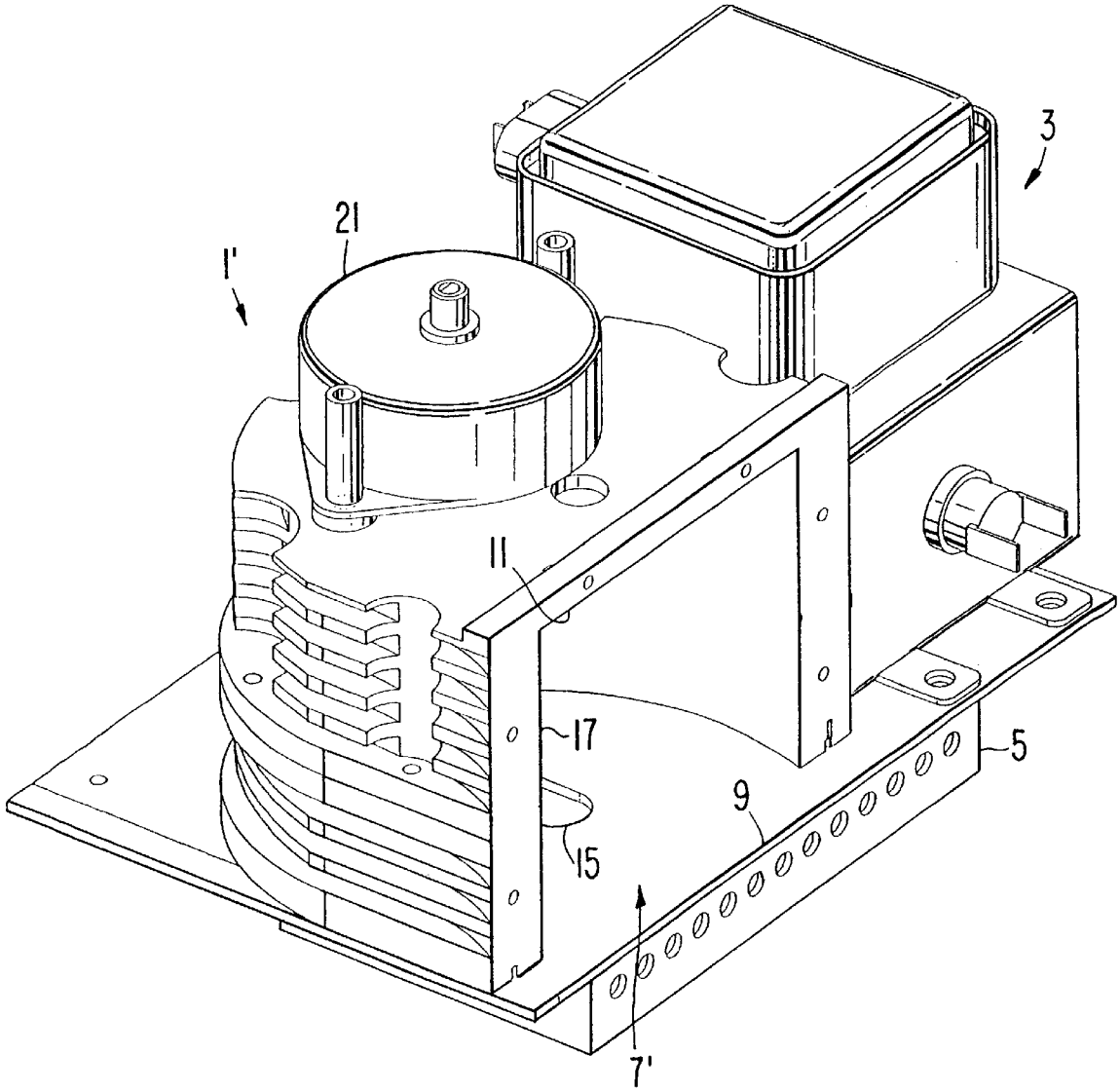
FIG. 1*b* is a perspective of a second embodiment of the present invention.

FIG. 1*b* shows lamp 1', which is similar to lamp 1 of FIG. 1*a* but differs therefrom in that light from lamp 1' in FIG. 1*b* is directed in a different direction than that of light from lamp 1 in FIG. 1*a*. That is, in FIG. 1*a*, the opening in cavity 7 is such that light from lamp 1 is irradiated in a direction of the axis of waveguide 5 (the direction that microwaves pass through waveguide 5 from magnetron 3 to RF slot 15). In FIG. 1*b*, cavity 7' has been rotated 90° such that light from lamp 1' irradiates in a direction perpendicular to the axis of waveguide 5. As can be appreciated, other directions for light irradiation from the lamp can be achieved. Thus, the lamp according to the present invention provides excellent flexibility with respect to the direction that the light irradiates therefrom.

As can be appreciated from FIG. 1*a*, both magnetron 3 and cavity 7 are provided on a same side of waveguide 5.

This provides a most compact structure, a desired feature according to the present invention.

Figure 2:
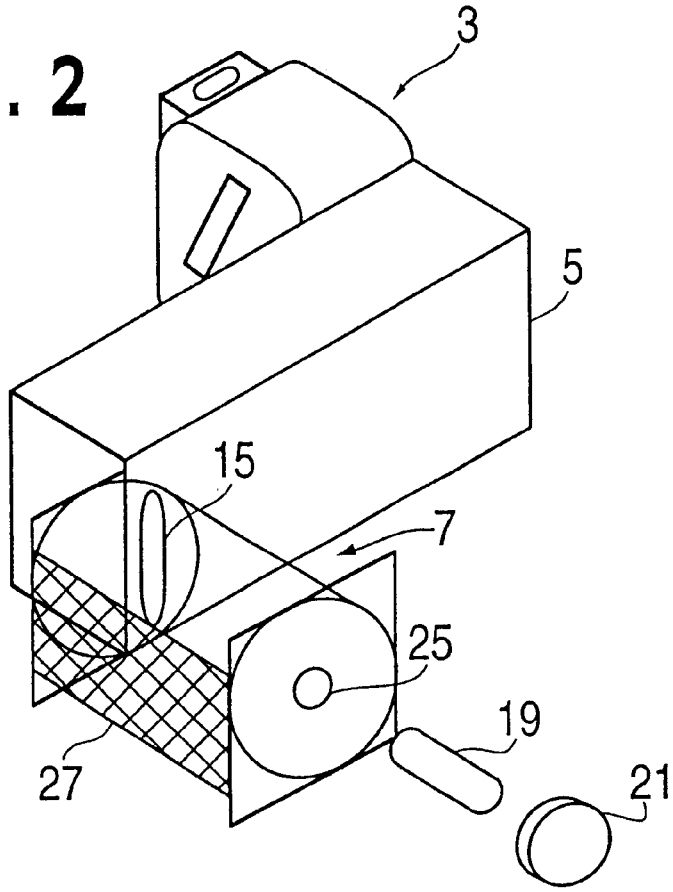
FIG. 2 is a perspective, partially exploded view of a third embodiment of the present invention.

However, according to the present invention, magnetron 3 and RF cavity 7 need not be on a same side of waveguide 5. FIG. 2 shows an embodiment where magnetron 3 and cavity 7 are both at the sides of waveguide 5 near respective ends thereof, similar to the embodiment shown in FIG. 1*a*, but are provided on opposite sides of waveguide 5, contrary to the embodiment in FIG. 1*a*.

Also shown in FIG. 2 is opening 25 for inserting bulb 19 into cavity 7. Further shown in FIG. 2 is RF screen 27 provided over the opening of the partial elliptical shaped cavity. As can be appreciated by one of ordinary skill in the art, this RF screen 27 is opaque to microwaves, yet is sufficiently transparent to emitted light such that an effective emission of light (e.g., ultraviolet light) from the lamp is achieved.

Figure 3:
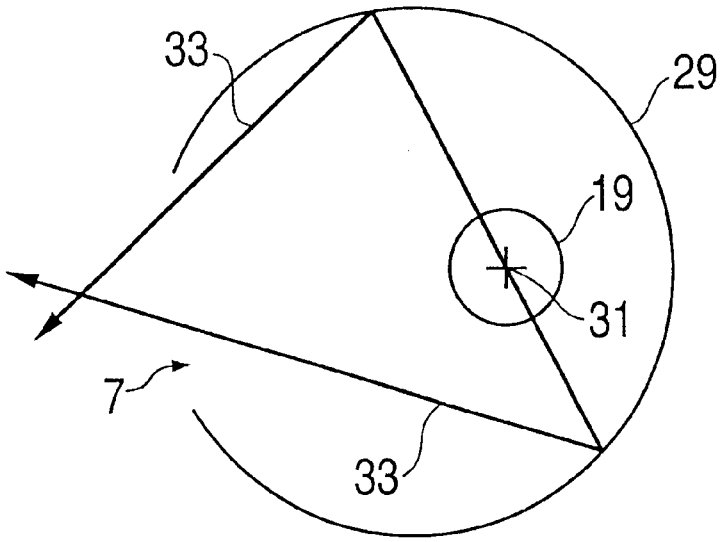
FIG. 3 shows the RF cavity of the present invention, showing bulb position therein.

FIG. 3 shows a cross-section of the partial elliptical-shaped cavity 7 in FIG. 2. As can be appreciated from FIG. 3, bulb 19 is placed at primary focal point 31 within RF cavity 7. This focal point 31 is the focal point of a complete ellipse, which would be formed from the partial elliptical shape. By desirably forming a reflector surface 29 for the shaped member forming the RF cavity, light rays emitted from the bulb and represented by reference character 33 in FIG. 3, can be reflected through the opening in the cavity so as to most efficiently and effectively emit light of a focused nature from lamp 1.

Figure 4:
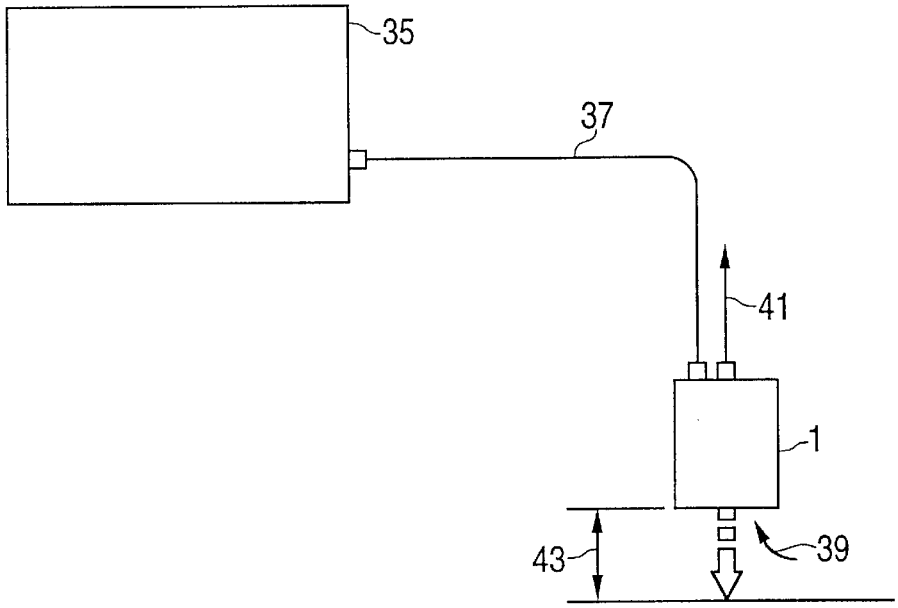
FIG. 4 is a schematic view of a lamp according to the present invention, applied to ultraviolet curing.

FIG. 4 shows a complete lamp system for generating and emitting light. Shown by reference character 35 is a power supply. This power supply, for example, can be a 230 volt AC, 50 Hz, single phase, power supply. This power supply can be connected to the magnetron of lamp 1 by high-voltage cable 37, for example, a 6 meter high-voltage cable. Illustratively, the lamp (irradiator), seen in FIG. 4, can have dimensions of 165 mm×165 mm×200 mm (height), and can weigh, e.g., 2.9 kg. Use of this compact lamp structure enables outputted ultraviolet light to be focused as close as 7 mm from the irradiator (a distance represented by reference character 43 in FIG. 4).

Also shown schematically in FIG. 4 is air inlet 39 and exhaust air 41. This passage of air acts to cool both the magnetron and lamp bulb. Illustratively, and not to be limiting, the exhaust air can exit through a 2.5 inch ID hose, which is 4.5 meters long. The air can be forced into the air inlet by providing a negative air pressure of 40–50 mm $H_2O$ at the air outlet.

In general, the microwave-powered lamp structure according to the present invention can be formed utilizing conventional materials as known in the art, and, as indicated previously, can use a conventional consumer oven magnetron. It is desired that lightweight materials (e.g., aluminum) be used, in order to provide the most lightweight lamp. The waveguide can have, for example, a rectangular cross-section, and be a box-shaped metal, of conventional metal materials. Holes 6 can be provided in waveguide 5, for purposes of facilitating flow of cooling fluid (e.g., air) between the magnetron and bulb through the RF slot, as discussed previously. The members forming boundaries of the RF cavity can be made of conventional materials; as indicated previously, it is desired that cavity 7 be provided with reflective material, known in the art, forming the boundaries thereof, for efficiently and effectively reflecting light emitted from bulb 19.

As discussed previously, while the compact lamp structure according to the present invention has many varied uses, one desirable use is as part of an inkjet system which uses, for example, ultraviolet light curable ink, with ultraviolet light from the compact microwave-powered lamp according to the present invention, having an ultraviolet light emitting bulb, being used to cure deposited ink.

Figure 5A:
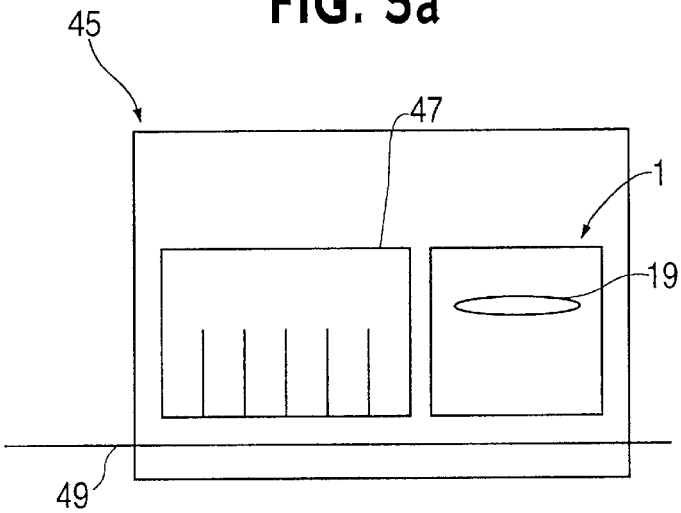
FIGS. 5*a* and 5*b* are schematic views of use of the lamp according to the present invention in an inkjet system for wire marking, with FIG. 5*a* showing a side view and FIG. 5*b* showing a cross-section of FIG. 5*a* through the lamp according to the present invention.
Figure 5B:
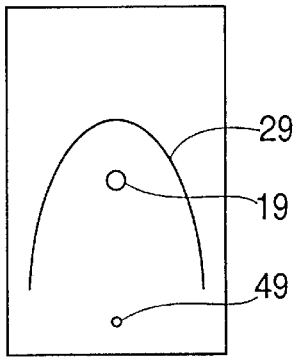

Shown in FIGS. 5*a* and 5*b* is inkjet system 45 for depositing ink on a receiving member. The receiving member in system 45 in FIGS. 5*a* and 5*b* is wire 49, which is marked using inkjet head 47, and the deposited ink then cured using microwave-powered lamp 1. FIG. 5*a* shows schematically the inkjet head 47 and lamp 1 positioned with the lamp 1 just downstream from inkjet head 47, in a direction of wire 49 movement. FIG. 5*b* shows, for example, a cross-section through lamp 1, showing, schematically, reflector 29, bulb 19 and wire 49. As can be appreciated, light emitted from bulb 19 is reflected off reflector 29 and focused at wire 49, which is located at the second focal point of the complete ellipse which would be formed by completing the partial elliptical shape of reflector 29. Bulb 19 is provided at the other (primary) focal point of this complete ellipse.

Figure 6:
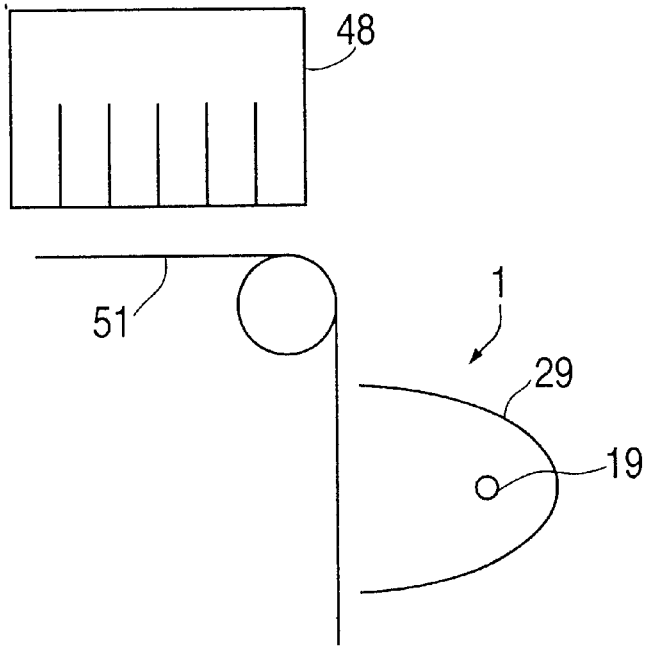
FIG. 6 is a schematic view of use of the lamp in an inkjet system for web printing.

Another embodiment of use of lamp 1 according to the present invention is seen in FIG. 6. This illustrates printing from an inkjet printer on a web as the ink-receiving material. Shown in FIG. 6 is inkjet head 48 and lamp 1, the lamp being downstream from inkjet head 48 in the direction of movement of web 51. After depositing of, for example, an ultraviolet light curable ink on web 51 from inkjet head 48, the ink is cured by irradiating ultraviolet light emitted from bulb 19 on web 51. FIG. 6 also shows reflector surface 29.

Figure 7:
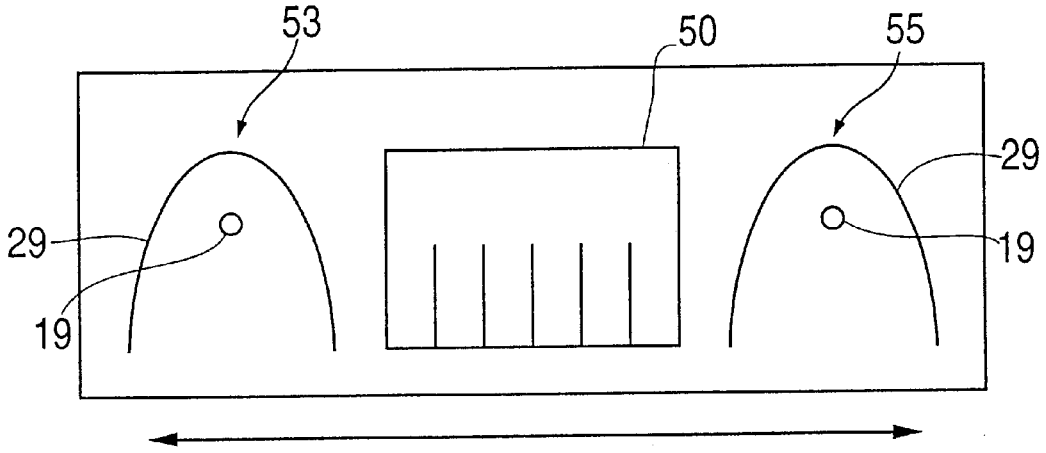
FIG. 7 is a schematic view of use of the lamp according to the present invention in an inkjet system, according to another embodiment.

Shown in FIG. 7 is another embodiment of the present invention, using two compact microwave-powered lamps. These two lamps 53, 55 can each be a microwave-powered lamp according to-the present invention, each having reflector surface 29 and bulb 19. These two lamps sandwich inkjet head 50, and form a row therewith.

The inkjet head can deposit ink according to signals generated, for example, by a desktop computer, as known in the art. The printer can also deposit ink responsive to signals from other devices, including, for example, digital cameras, scanners, etc., as known in the art.

Accordingly, by the present invention, a compact microwave-powered lamp, capable of providing, e.g., stable ultraviolet light output during operation, having less weight and low air cooling requirements, and providing a rotating tubular lamp for uniform stress along the bulb wall from both thermal and electric field stresses, is achieved. Moreover, this, e.g., ultraviolet light-emitting lamp can start without an ignitor bulb, and can move the product focus closer to the lamp.

While several embodiments in accordance with the present invention have been shown and described, it is understood that the same is not limited thereto, but is susceptible of numerous changes and modifications as known to those skilled in the art. Therefore, we do not wish to be limited to the details shown and described herein, but intend to cover all such changes and modifications as are encompassed by the scope of the appended claims.

What is claimed is:

1. Structure of a microwave-powered lamp, comprising:

a microwave generator;

an RF cavity, adapted to have positioned therein a bulb of said microwave-powered lamp; and a waveguide for directing microwaves generated by said microwave generator to said cavity;

wherein the cavity is defined by end members and a member extending therebetween, the member extending between the end members being a reflector of light emitted from the bulb, wherein the cavity is positioned adjacent to the waveguide such that one of the end members is positioned so as to overlap a side of the waveguide, and wherein an RF slot extends from the waveguide through said one of the end members into said RF cavity, for introduction of the microwaves from the waveguide into the RF cavity.

2. Structure according to claim 1, wherein another of the end members defining the cavity, opposite the end member adjacent the waveguide, has an opening therethrough for inserting said bulb into said cavity.

3. Structure according to claim 1, wherein the microwave generator is a magnetron.

4. Structure according to claim 2, wherein the cavity has a partial elliptical shape in a cross-section parallel to the end members.

5. Structure according to claim 4, wherein said opening is positioned such that the bulb, when inserted into the cavity through the opening, is located at a focal point of the partial elliptical shape.

6. Structure according to claim 1, wherein the cavity has a partial elliptical shape in a cross-sectional parallel to the end members.

7. Structure according to claim 1, further comprising structure to direct a cooling fluid through the cavity, to cool the bulb, wherein the cooling fluid passes through said RF slot.

8. Structure according to claim 7, wherein the structure to direct the cooling fluid also directs the cooling fluid past the microwave generator to cool the microwave generator.

9. Structure according to claim 7, wherein the structure to direct the cooling fluid is a structure to direct air as the cooling fluid.

10. Structure according to claim 7, wherein the structure to direct the cooling fluid is adapted to create a positive pressure in the cavity.

11. Structure according to claim 7, wherein the structure to direct the cooling fluid is adapted to create a negative pressure in the cavity.

12. Structure according to claim 1, wherein the end members are end reflectors of light emitted from the bulb.

13. Structure according to claim 12, wherein the member extending between the end members has a cross-sectional shape of a partial ellipse, which is open at one end, and the open end of the partial ellipse is covered with an RF screen.

14. Structure according to claim 13, wherein the waveguide has an axial length extending in a first direction, and the cavity is positioned such that light emitted from the open end of the partial ellipse is emitted substantially in said first direction.

15. Structure according to claim 1, wherein said waveguide has two opposed ends, and the microwave generator is adjacent one of the two opposed ends, and the cavity is adjacent the other of the two opposed ends, of the waveguide.

16. Structure according to claim 15, wherein the microwave generator and the cavity are respectively adjacent the two opposed ends of the waveguide, on a same side of the waveguide.

17. Microwave-powered lamp, comprising:

structure according to claim 1; and a bulb, positioned in the RF cavity.

18. Microwave-powered lamp according to claim 17, wherein the bulb is tubular and has a central axis, wherein the bulb extends into the RF cavity from an end member, defining the cavity, opposite said one of the end members, and wherein an extension of said central axis intersects said RF slot.

19. Microwave-powered lamp according to claim 17, wherein the lamp is an electrodeless lamp.

20. Microwave-powered lamp according to claim 19, wherein the bulb is adapted to emit at least one of visible and ultraviolet light when excited by the microwaves.

21. Microwave-powered lamp according to claim 17, wherein the lamp does not include an ignitor bulb.

22. Microwave-powered lamp according to claim 17, wherein the cavity has a cross-sectional shape, parallel to the end members, of a partial ellipse, providing an opening from the cavity for light emitted from the bulb to be emitted from the cavity, and wherein the bulb is positioned at a focal point of the partial ellipse.

23. Microwave-powered lamp according to claim 17, further comprising structure to rotate the bulb when the bulb is positioned in the cavity.

24. Microwave-powered lamp according to claim 17, wherein the bulb is a bulb which, when excited by the microwaves, emits at least one of visible and ultraviolet light.

25. A Microwave-powered lamp according to claim 17, further comprising structure for cooling the bulb by passing a cooling fluid through said cavity to cool said bulb, the cooling fluid passing through said slot.

26. Microwave-powered lamp according to claim 25, wherein the structure for cooling the bulb includes a structure for passing air by the bulb.

27. Microwave-powered lamp according to claim 25, wherein the structure for cooling the bulb also causes cooling of the microwave generator by passing a cooling fluid by the microwave generator.

28. Inkjet head, comprising:

at least one print head for delivering an ink or coating material to a receiving member, for depositing the ink or coating material on the receiving member; and the microwave-powered lamp according to claim 18, for curing the ink or coating material.

29. Inkjet head according to claim 28, wherein the inkjet head includes at least three print heads respectively for printing different colored inks, whereby the inkjet head can print in colors.

30. Inkjet head according to claim 28, wherein the microwave-powered lamp moves with the at least one print head.

31. Inkjet head according to claim 28, wherein the microwave-powered lamp remains stationary, upon movement of the at least one print head.

32. Inkjet head according to claim 28, wherein the at least one print head is for delivering ultraviolet light curable ink to the receiving member, and wherein the microwave-powered lamp emits ultraviolet light so as to cure the ultraviolet light curable ink.

33. Inkjet head according to claim 28, wherein the microwave-powered lamp is a first microwave-powered lamp, wherein the inkjet head further comprises at least one further microwave-powered lamp, and wherein the first microwave-powered lamp, at least one print head and at least one further microwave-powered lamp are provided in a single row.

34. Inkjet head according to claim 28, wherein the microwave-powered lamp is a first microwave-powered lamp, wherein the inkjet head further comprises at least a second microwave-powered lamp, said at least a second microwave-powered lamp being substantially the same as the first microwave-powered lamp, and wherein the first microwave-powered lamp, at least one print head and said at least a second microwave-powered lamp are in a single row, the first microwave-powered lamp and at least a second microwave-powered lamp sandwiching the at least one print head, such that at least one microwave-powered lamp is at each side of the at least one print head.

35. Inkjet head according to claim 28, wherein the microwave-powered lamp is an electrodeless lamp.

36. Inkjet head according to claim 28, wherein the microwave-powered lamp is a first microwave-powered lamp, and wherein the inkjet head further comprises at least one second microwave-powered lamp.

37. Inkjet printing apparatus, comprising:

the inkjet head according to claim 28; and a support for the receiving member upon which ink is to be deposited.

38. Inkjet printing apparatus according to claim 37, wherein said support is a support for a wire-shaped member, whereby a wire-shaped member can be provided with marking.

39. Inkjet printing apparatus according to claim 37, wherein said support is a support for a web of material of the receiving member, and wherein the inkjet printing apparatus further includes structure to cause relative movement between the web of material and the inkjet head in a lengthwise direction of the web.

40. Inkjet printing apparatus according to claim 37, wherein said receiving member is a sheet, said support being a support for the sheet, and wherein the inkjet printing apparatus further includes structure to cause relative movement between the inkjet head and the sheet in a lengthwise direction of the sheet.

41. Inkjet printing apparatus according to claim 37, wherein the apparatus includes structure for moving at least one of the support and inkjet head relative to each other.

42. A method of operating the microwave-powered lamp of claim 17, comprising the steps of supplying power to the microwave generator so as to generate the microwaves, passing the microwaves through the waveguide into the cavity through the RF slot in said one of the end members, and emitting light from the bulb arising from fill material in the bulb, the light being emitted due to excitation of the fill material in the bulb by the microwaves.

43. Method according to claim 42, wherein during operation of the microwave-powered lamp the bulb is rotated.

44. Method according to claim 43, wherein during operation of the microwave-powered lamp a cooling fluid is passed into the cavity to cool the bulb, the cooling fluid being passed through the RF slot in its passage for cooling the bulb.

45. Method according to claim 44, wherein the cooling fluid is air.

46. Method according to claim 44, wherein the cooling fluid used to cool the bulb is also passed by the microwave generator, to cool the microwave generator.

47. Method according to claim 42, wherein the microwave-powered lamp is an electrodeless lamp.

48. Method according to claim 42, wherein during operation of the microwave-powered lamp a cooling fluid is passed into the cavity to cool the bulb, the cooling fluid being passed through the RF slot in its passage for cooling the bulb.

49. Method according to claim 48, wherein the cooling fluid used to cool the bulb is also passed by the microwave generator, to cool the microwave generator.

50. Inkjet printing method, comprising the steps of:

applying ink from at least one inkjet printing head onto a receiving member; and curing the ink by emitting radiation from the microwave-powered lamp according to claim 17.

51. Inkjet printing method according to claim 50, wherein the ink is an ultraviolet light curable ink, and the microwave-powered lamp emits ultraviolet light for curing the ultraviolet light curable ink.

52. Inkjet printing method according to claim 50, wherein the receiving member is a wire.

53. Inkjet printing method according to claim 50, wherein the receiving member is a sheet of material upon which the ink is applied.

54. Inkjet printing method according to claim 50, wherein the receiving member is a web of material upon which the ink is applied.

55. Inkjet printing method according to claim 50, wherein the microwave-powered lamp is on a same support as the at least one inkjet printing head, and moves with the at least one inkjet printing head.

56. Inkjet printing method according to claim 50, wherein the microwave-powered lamp remains stationary when the at least one inkjet printing head moves.

57. Inkjet printing method according to claim 50, wherein the microwave-powered lamp is an electrodeless lamp.

58. Inkjet printing method according to claim 50, wherein the bulb is rotated when the microwave-powered lamp is emitting radiation to cure the ink.

59. Inkjet printing method according to claim 59, wherein the bulb is cooled during said curing, by passing a cooling fluid by the bulb, the cooling fluid also passing through said RF slot.

60. Inkjet printing method according to claim 59, wherein the cooling fluid passed by the bulb also passes by the microwave generator, to cool the microwave generator.

61. Inkjet printing method according to claim 50, wherein the bulb is cooled during said curing, by passing a cooling fluid by the bulb, the cooling fluid also passing through said RF slot.

62. Structure of a microwave-powered lamp, comprising:

a microwave generator;

an RF cavity, adapted to have positioned therein a bulb of said microwave-powered lamp; and a waveguide for directing microwaves generated by said microwave generator to said cavity;

wherein the cavity is defined by end members and a member extending therebetween, wherein the cavity is positioned adjacent to the waveguide such that one of the end members is positioned so as to overlap a side of the waveguide, and wherein an RF slot extends from the waveguide through said one of the end members into said RF cavity, for introduction of the microwaves from the waveguide into the RF cavity, and wherein another of the end members defining the cavity, opposite the end member adjacent the waveguide, has an opening therethrough for inserting said bulb into said cavity.

63. Structure according to claim 62, further comprising structure to rotate the bulb when the bulb is positioned in the cavity.

64. Structure of a microwave-powered lamp, comprising:

a microwave generator;

an RF cavity, adapted to have positioned therein a bulb of said microwave-powered lamp; and a waveguide for directing microwaves generated by said microwave generator to said cavity;

wherein the cavity is defined by end members and a member extending therebetween, wherein the cavity has a partial elliptical shape in a cross-section parallel to the end members, wherein the cavity is positioned adjacent to the waveguide such that one of the end members is positioned so as to overlap a side of the waveguide, and wherein an RF slot extends from the waveguide through said one of the end members into said RF cavity, for introduction of the microwaves from the waveguide into the RF cavity.

65. Microwave-powered lamp, comprising:

a microwave generator;

an RF cavity, having positioned therein a bulb of said microwave-powered lamp; and a waveguide for directing microwaves generated by said microwave generator to said cavity;

wherein the cavity is defined by end members and a member extending therebetween, wherein the cavity is positioned adjacent to the waveguide such that one of the end members is positioned so as to overlap a side of the waveguide, wherein the cavity has a cross-sectional shape, parallel to the end members, of a partial ellipse, providing an opening from the cavity for light emitted from the bulb to be emitted from the cavity, and wherein the bulb is positioned at a focal point of the partial ellipse, and wherein an RF slot extends from the waveguide through said one of the end members into said RF cavity, for introduction of the microwaves from the waveguide into the RF cavity.

66. Microwave-powered lamp according to claim 65, wherein the bulb is positioned at a focal point within the cavity.

67. Microwave-powered lamp, comprising:

a microwave generator;

an RF cavity, having positioned therein a bulb of said microwave-powered lamp; and a waveguide for directing microwaves generated by said microwave generator to said cavity;

wherein the cavity is defined by end members and a member extending therebetween, wherein the cavity is positioned adjacent to the waveguide such that one of the end members is positioned so as to overlap a side of the waveguide, wherein an RF slot extends from the waveguide through said one of the end members into said RF cavity, for introduction of the microwaves from the waveguide into the RF cavity, and wherein the bulb is tubular and has a central axis, wherein the bulb extends into the RF cavity from an end member, defining the cavity, opposite said one of the end members, and wherein an extension of said central axis intersects said RF slot.

68. Microwave-powered lamp according to claim 67, further comprising structure to rotate the bulb when positioned in the cavity.

69. Microwave-powered lamp according to claim 68, further comprising structure for cooling the bulb by passing a cooling fluid through said cavity to cool said bulb, the cooling fluid passing through said slot.

70. Microwave-powered lamp according to claim 69, wherein the structure for cooling the bulb also causes cooling of the microwave generator by passing a cooling fluid by the microwave generator.

71. Inkjet head, comprising:

at least one print head for delivering an ink or coating material to a receiving member, for depositing the ink or coating material on the receiving member; and a microwave-powered lamp, for curing the ink or coating material, including:

a microwave generator;

an RF cavity, having positioned therein a bulb of said microwave-powered lamp; and a waveguide for directing microwaves generated by said microwave generator to said cavity, wherein the cavity is defined by end members and a member extending therebetween, wherein the cavity is positioned adjacent to the waveguide such that one of the end members is positioned so as to overlap a side of the waveguide, wherein an RF slot extends from the waveguide through said one of the end members into said RF cavity, for introduction of the microwaves from the waveguide into the RF cavity, and wherein the microwave-powered lamp is a first microwave-powered lamp, wherein the inkjet head further comprises at least one further microwave-powered lamp, and wherein the first microwave-powered lamp, at least one print head and at least one further microwave-powered lamp are provided in a single row.

72. Inkjet head, comprising:

at least one print head for delivering an ink or coating material to a receiving member, for depositing the ink or coating material on the receiving member; and a microwave-powered lamp, for curing the ink or coating material, including:

a microwave generator;

an RF cavity, having positioned therein a bulb of said microwave-powered lamp; and a waveguide for directing microwaves generated by said microwave generator to said cavity, wherein the cavity is defined by end members and a member extending therebetween, wherein the cavity is positioned adjacent to the waveguide such that one of the end members is positioned so as to overlap a side of the waveguide, wherein an RF slot extends from the waveguide through said one of the end members into said RF cavity, for introduction of the microwaves from the waveguide into the RF cavity, and wherein the microwave-powered lamp is a first microwave-powered lamp, wherein the inkjet head further comprises at least a second microwave-powered lamp, said at least a second microwave-powered lamp being substantially the same as the first microwave-powered lamp, and wherein the first microwave-powered lamp, at least one print bead and said at least a second microwave-powered lamp are in a single row, the first microwave-powered lamp and at least a second microwave-powered lamp sandwiching the at least one print bead, such that at least one microwave-powered lamp is at each side of the at least one print head.

73. A microwave-powered lamp, comprising:

a microwave generator;

an RF cavity, having positioned therein a bulb, the bulb having a central axis; and a waveguide for directing microwaves generated by said microwave generator to said cavity, the waveguide having an RF slot therein for introducing the microwaves from the waveguide to the RF cavity, wherein the slot extends so as to introduce the microwaves into one end of the cavity, wherein the bulb is positioned in the cavity extending from an end of the cavity opposite said one end, and wherein the bulb is positioned in the cavity such that an extension of the central axis thereof intersects the slot.

74. Microwave-powered lamp according to claim 73, further comprising structure to rotate the bulb in said cavity.

75. Microwave-powered lamp according to claim 74, further comprising structure for cooling the bulb by passing a cooling fluid past the bulb, the cooling fluid passing through said slot.

76. Microwave-powered lamp according to claim 75, wherein the structure for cooling the bulb also causes the cooling fluid to flow past the microwave generator, to cool the microwave generator.

77. Microwave-powered lamp according to claim 73, further comprising structure for cooling the bulb by passing a cooling fluid past the bulb, the cooling fluid passing through said slot.

78. Inkjet head, comprising:

at least one print head for delivering an ink or coating material to a receiving member, for depositing the ink or coating material on the receiving member; and a microwave-powered lamp, for curing the ink or coating material, including:

a microwave generator;

an RF cavity, having positioned therein a bulb of said microwave-powered lamp; and a waveguide for directing microwaves generated by said microwave generator to said cavity, wherein the cavity is defined by end members and a member extending therebetween, wherein the cavity is positioned adjacent to the waveguide such that one of the end members is positioned so as to overlap a side of the waveguide, wherein an RF slot extends from the waveguide through said one of the end members into said RF cavity, for introduction of the microwaves from the waveguide into the RF cavity, wherein the microwave-powered lamp is a first microwave-powered lamp, and wherein the inkjet head further comprises at least one second microwave-powered lamp.

79. Inkjet head according to claim 78, wherein said at least one second microwave-powered lamp is substantially the same as the first microwave-powered lamp.

* * * * *